US008622244B2

(12) United States Patent
Stoeckli et al.

(10) Patent No.: US 8,622,244 B2
(45) Date of Patent: Jan. 7, 2014

(54) DISPENSING ASSEMBLY COMPRISING A CARTRIDGE WITH BAG

(75) Inventors: Rochus Stoeckli, Buochs (CH); Andy Greter, Steinhausen (CH); Wilhelm A. Keller, Merlischachen (CH)

(73) Assignee: Medmix Systems AG, Rotkreuz (CH)

( * ) Notice: Subject to any disclaimer, the term of this patent is extended or adjusted under 35 U.S.C. 154(b) by 139 days.

(21) Appl. No.: 13/003,549

(22) PCT Filed: Jul. 3, 2009

(86) PCT No.: PCT/CH2009/000232

§ 371 (c)(1),
(2), (4) Date: Jan. 10, 2011

(87) PCT Pub. No.: WO2010/006455

PCT Pub. Date: Jan. 21, 2010

(65) Prior Publication Data

US 2011/0108573 A1 May 12, 2011

(30) Foreign Application Priority Data

Jul. 14, 2008 (CH) ..... 1090/08

(51) Int. Cl.
*B67D 1/00* (2006.01)

(52) U.S. Cl.
USPC ..... 222/83; 222/87; 222/82; 222/137

(58) Field of Classification Search
USPC ..... 222/105, 145.5, 80–91, 132, 325–327, 222/137, 135, 541.1–541.2, 541.4, 541.6; 220/277
See application file for complete search history.

(56) References Cited

U.S. PATENT DOCUMENTS

| | | | | | |
|---|---|---|---|---|---|
| 3,193,146 | A | | 7/1965 | Isgriggs et al. | |
| 3,964,641 | A | | 6/1976 | Langensiepen et al. | |
| 4,355,737 | A | * | 10/1982 | Pongrass et al. | 222/81 |
| 4,475,670 | A | * | 10/1984 | Rutter | 222/83 |
| 4,562,940 | A | * | 1/1986 | Asphar | 222/88 |
| 4,801,008 | A | | 1/1989 | Rich | |
| 4,981,241 | A | * | 1/1991 | Keller | 222/137 |

(Continued)

FOREIGN PATENT DOCUMENTS

| | | | |
|---|---|---|---|
| DE | 3826887 | A1 | 2/1990 |
| DE | 196 18 693 | A1 | 11/1997 |

(Continued)

OTHER PUBLICATIONS

PCT International Search Report and Written Opinion on Application No. PCT/CH2009/000232 dated Sep. 11, 2009; 9 pages.

*Primary Examiner* — Paul R Durand
*Assistant Examiner* — Robert Nichols, II
(74) *Attorney, Agent, or Firm* — Foley & Lardner LLP

(57) ABSTRACT

A dispensing assembly includes a double cartridge having two storage containers with bags placed therein, a mixer that is connectable to the cartridge, and an opening device acting upon the bag. The opening device is arranged on the mixer housing and rotatable with respect to the cartridge and has a cutting member including two knife-edges that acts essentially perpendicular to the longitudinal axis of the bags within the cartridge. Due to the knife-edges being rotatable and arranged laterally with respect to the bags, the cutting member allows a clean and predetermined opening of the bags and a dispensing operation with minimum pressure losses and lost volumes.

21 Claims, 4 Drawing Sheets

(56) References Cited

U.S. PATENT DOCUMENTS

| | | | | |
|---|---|---|---|---|
| 5,152,432 | A * | 10/1992 | De Laforcade | 222/145.1 |
| 5,161,715 | A * | 11/1992 | Giannuzzi | 222/82 |
| 5,697,524 | A * | 12/1997 | Sedlmeier | 222/82 |
| 5,897,028 | A * | 4/1999 | Sauer | 222/82 |
| 6,012,610 | A * | 1/2000 | Pauser et al. | 222/88 |
| 6,296,149 | B1 * | 10/2001 | Long | 222/82 |
| 6,352,177 | B1 * | 3/2002 | Bublewitz et al. | 222/82 |
| 6,409,972 | B1 * | 6/2002 | Chan | 422/131 |
| 6,564,970 | B1 | 5/2003 | Walch et al. | |
| 6,644,509 | B1 | 11/2003 | Bublewitz et al. | |
| 6,659,994 | B1 * | 12/2003 | Mader et al. | 604/408 |
| 8,162,179 | B2 * | 4/2012 | Willner et al. | 222/82 |
| 2003/0049179 | A1 * | 3/2003 | Snedden | 422/100 |
| 2003/0051610 | A1 | 3/2003 | Dux et al. | |
| 2008/0287880 | A1 * | 11/2008 | Keller | 604/191 |
| 2010/0038380 | A1 * | 2/2010 | Compton | 222/105 |
| 2011/0138741 | A1 * | 6/2011 | Stoeckli et al. | 53/167 |
| 2012/0104030 | A1 * | 5/2012 | Springhorn et al. | 222/1 |
| 2013/0087578 | A1 * | 4/2013 | Brem et al. | 222/82 |

FOREIGN PATENT DOCUMENTS

| | | | |
|---|---|---|---|
| EP | 0 154 345 | A2 | 9/1985 |
| EP | 1 112 779 | B1 | 7/2001 |
| FR | 2 761 346 | A1 | 10/1998 |
| NL | 9200318 | | 9/1993 |
| WO | WO 00/61457 | | 10/2000 |
| WO | WO 00/76676 | A1 | 12/2000 |
| WO | WO 01/44074 | A1 | 6/2001 |

* cited by examiner

DISPENSING ASSEMBLY COMPRISING A CARTRIDGE WITH BAG

CROSS-REFERENCE TO RELATED PATENT APPLICATIONS

Switzerland Priority Application 01090/08, filed Jul. 14, 2008 including the specification, drawings, claims and abstract, is incorporated herein by reference in its entirety.

FIELD OF THE INVENTION

The present invention relates to a dispensing assembly comprising a cartridge having at least one storage container with a bag placed therein, an accessory that is connectable to the cartridge, and opening means acting upon the bag.

BACKGROUND OF THE INVENTION

A dispensing assembly of this kind is e.g. known from DE 19618693, EP 1 112 779, or WO 0061457. These and other dispensing assemblies with bags have in common that the opening, resp. cutting member essentially acts in the longitudinal direction of the cartridge and of the accessory, i.e. frontal on the bag(s) within the cartridge.

Particularly in multiple cartridges, this opening procedure has the following disadvantages:

A restriction of the bag opening since the opening mechanism and the cartridge outlet diameter are interdependent.

Large volumes of lost material since the path up to the point where the two components are merged can only be realized by long channels leading to the mixer.

In the case of highly viscous materials, the pressure drop is high because the two components cannot be conducted from the bags into the mixer on the shortest and direct path.

Frontal piercing along the longitudinal axis of the bags entails the risk that the bag is torn in an undefined manner instead of being opened by a geometrically defined opening procedure.

Moreover, in the devices of the prior art, parts of the bag may involuntarily be torn off and possibly dispensed along with the mass in an uncontrolled manner.

SUMMARY OF THE INVENTION

On the background of this prior art, it is an object of the present invention to provide a dispensing assembly of the aforementioned kind that allows a controlled opening of the bag(s) and a clean dispensing while the pressure loss and the volume of lost outflowing material are to be kept as low as possible. This is accomplished by the dispensing assembly wherein the opening means comprises a cutting member having one or a plurality of knife-edge(s) that is (are) arranged and orientated to act essentially perpendicular to the longitudinal axis of the bag(s) within the cartridge. Further advantages and embodiments of the invention are described in the dependent claims.

BRIEF DESCRIPTION OF THE DRAWINGS

The invention will be explained in more detail hereinafter with reference to drawings of exemplary embodiments.

FIG. 1 shows a dispensing assembly 1 according to the invention with a double cartridge 2 including the two storage containers 3 and 4, and an accessory, in this case a mixer 5 that is connected to cartridge 2. Mixer housing 6 has two actuating wings 7.

In FIG. 2 it is seen that in storage containers 3 and 4 of the cartridge, respective bags 8 and 9 are placed in which different materials 8*a* and 9*a* may be contained. To the rear, at the end opposite the outlet, the cartridge is sealed by respective pistons 10.

Figure 1:
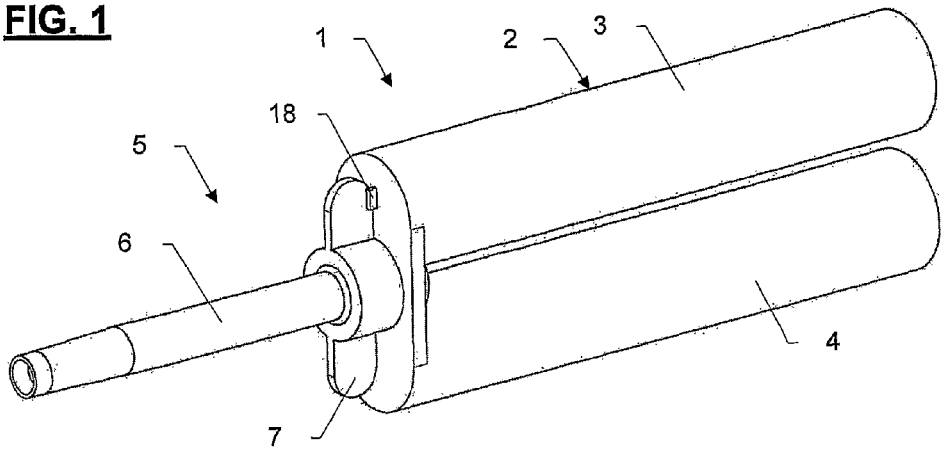
FIG. 1 shows a perspective view of an exemplary embodiment of a dispensing assembly according to the invention.

Mixer housing 6 holds mixing elements 11. Connected to mixing elements 11 is a driving member 12 on which a cutting member 13 is arranged which in the present case comprises two knife-edges that are designed with sharp edges 14 and may consist of the same material as the mixing elements or of metal or another material. Instead of two knife-edges, a single knife-edge may be used which in this case is rotatable by 360°.

Figure 2:
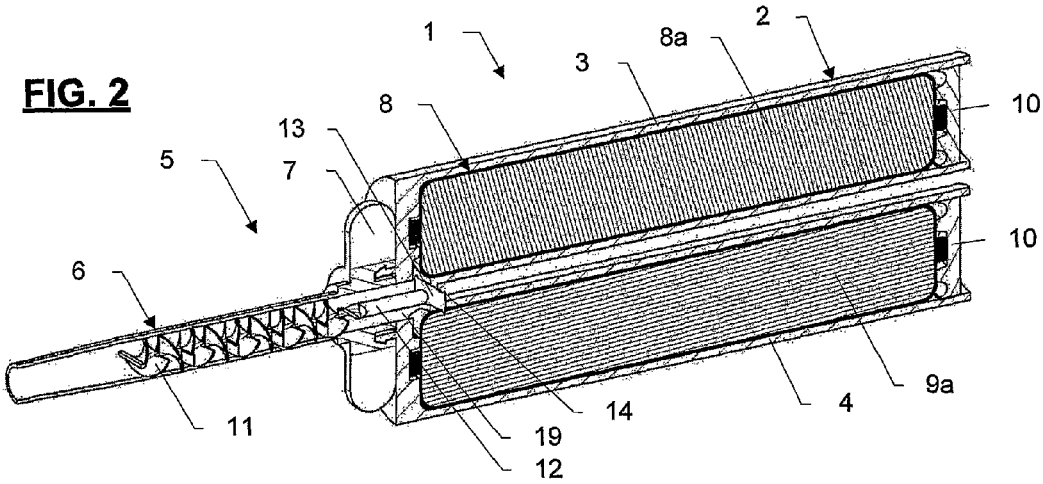
FIG. 2 shows a longitudinal section of the assembly of FIG. 1 in the unopened condition with a double cartridge and a cutting member with two knife-edges.

In the drawings it is seen that the cutting member or its knife-edges, respectively, are orientated and arranged essentially perpendicularly to the longitudinal axis of the cartridge to be active in this plane. Furthermore it appears in FIG. 2 that near the outlet of the cartridge, a cavity 19 is arranged in which the cutting member is rotatable.

Figure 3:
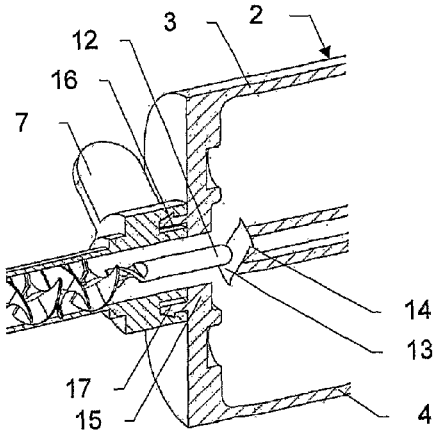
FIG. 3 shows, in a detail of FIG. 2, the cutting member in a partly rotated position.

It is further apparent in FIG. 3 that the mixer is fitted to the cartridge rotatably, the cartridge having an outlet flange 15 with a circumferential groove 16 in which a bead 17 at the inlet side end of the mixer housing engages. The actuating wings 7 arranged on the mixer housing facilitate the rotation of the housing and of the cutting member connected thereto. Instead of the circumferential groove, the cartridge may be provided with a corresponding fastening element for the rotatable attachment of the mixer.

In the case of a cutting member having a plurality of knife-edges, it is advantageous to provide a stop in order to prevent that it can be rotated more than 180° as the blade should no longer be active once the bag has been cut open. In FIG. 1, a stop cam 18 on the cartridge is shown, but a large number of other stop means are possible. Alternatively, instead of the stop means, a non-releasable snap arrangement may be provided so that the cutting member cannot be turned back after having opened the bag.

Figure 4:
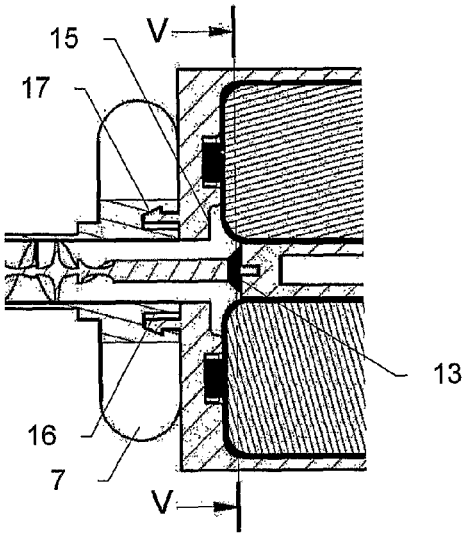
FIG. 4 shows an enlarged detail of FIG. 2.
Figure 5:
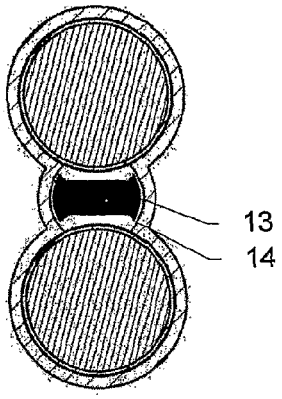
FIG. 5 shows a section according to line V-V in FIG. 4, FIGS. 6 and 7 are analogous to FIGS. 4 and 5, with a partly rotated cutting member during the operation of cutting the bag open.
Figure 6:
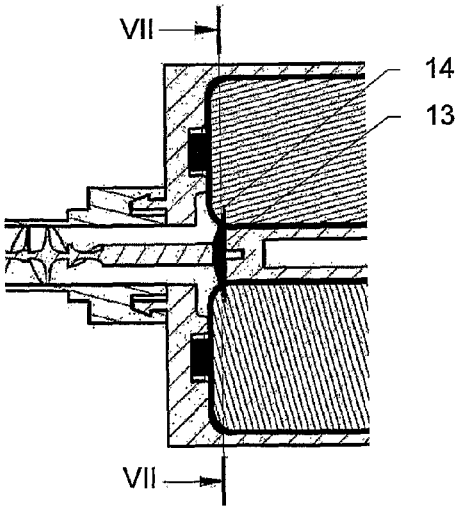
Figure 7:
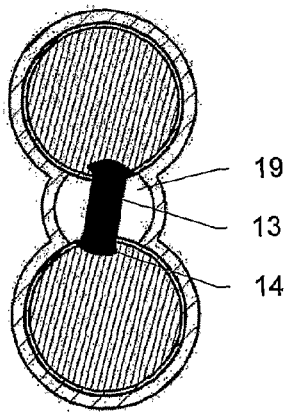

In FIGS. 4 and 5, respectively 6 and 7, the starting position and the beginning of the cutting operation are illustrated.

Figure 8:
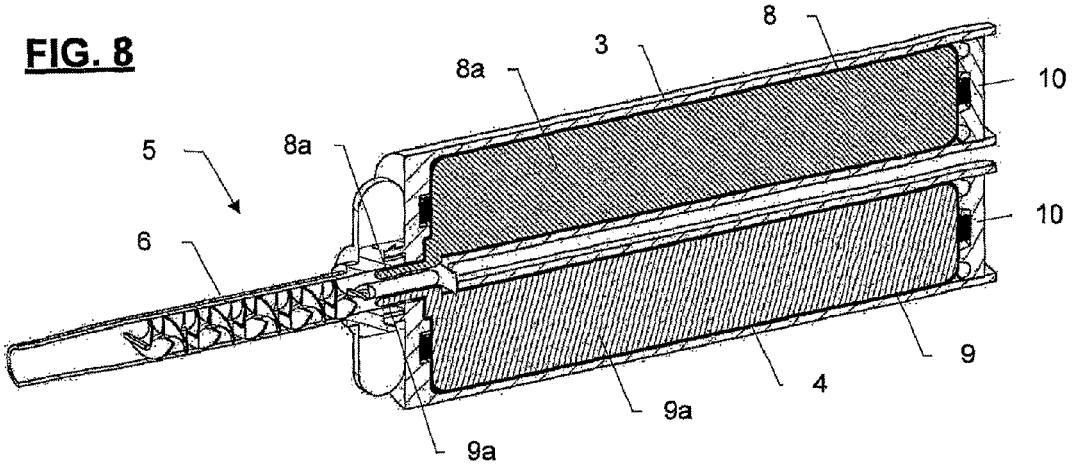
FIG. 8 shows the dispensing assembly after the bags have been cut open.
Figure 9:
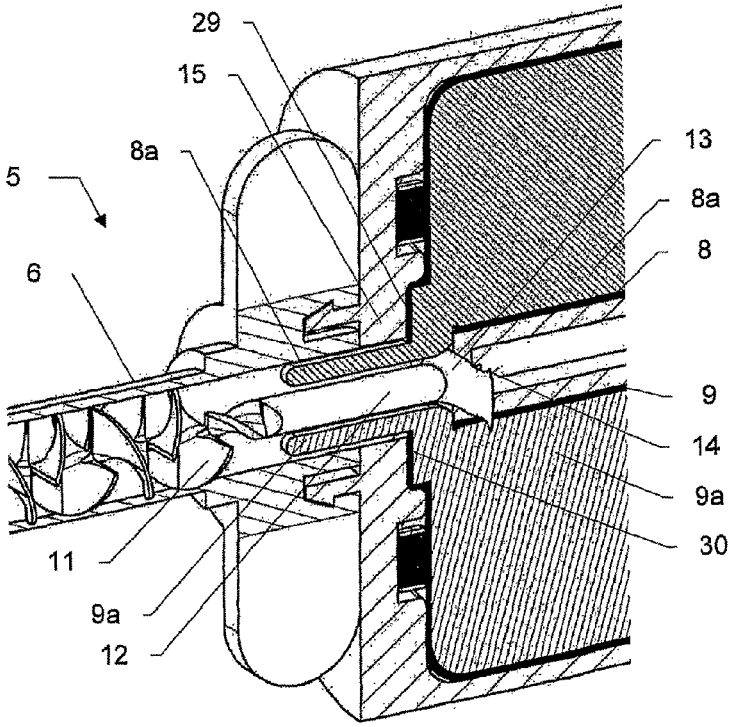
FIG. 9 shows an enlarged detail of FIG. 8, FIGS. 10 and 11 show an embodiment variant with three containers, the cutting member with three knife-edges being shown in two different positions.

In FIGS. 8 and 9, the dispensing assembly is illustrated after the bags have been cut open and at the beginning of dispensing. The double cartridge may be placed in a dispensing appliance that is known in the art per se and whose double plungers act upon pistons 10. As appears particularly in FIG. 9, the outflowing substances have pressed the two tabs 29 and 30 of bags 8 and 9 that are formed in the cutting operation against outlet flange 15, thereby creating a clearly defined opening of the bags so that the substances may reach the mixer inlet and thus the mixing elements. In this arrangement, the path to the mixing elements is direct and thus the pressure loss and the lost volume are minimum. Due to the fact that the cut-open wall of the bag lies on the cartridge outlet, there is no risk that frayed parts of the bag might be torn off.

Figure 10:
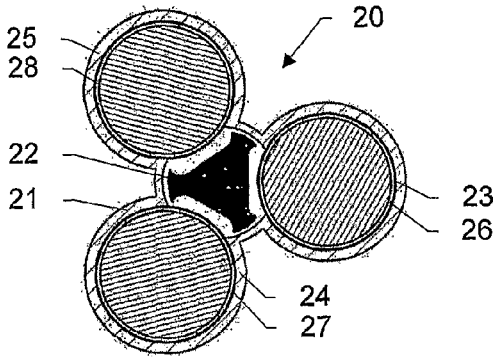
Figure 11:
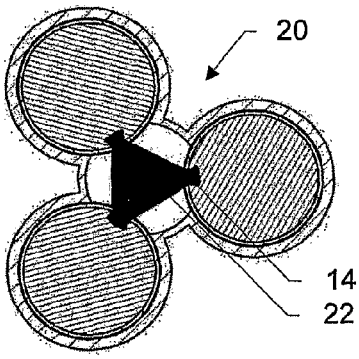

In FIGS. 10 and 11, a second dispensing assembly 20 is illustrated as an embodiment variant in which a cutting member 22 having three knife-edges is arranged between a triple cartridge 21, respective bags 26, 27, and 28 being placed in the three storage containers 23, 24, and 25. By a rotation of the housing with cutting member 22, the three bags can be opened simultaneously. It is possible in this arrangement also to use a single knife-edge, in which case the opening operation is carried out essentially simultaneously.

Instead of three or more storage containers in a corresponding cartridge, a single storage container with a single bag may be provided that is opened by a correspondingly shaped but similarly acting cutting member.

Moreover, the cutting member need not be connected to the mixing elements; both in a mixer and in a accessory of another kind, the cutting member may be connected to a ring that is arranged on the accessory and rotatable with respect to the cartridge. This is especially the case if a bayonet coupling between the cartridge and the accessory device is used. The cutting member may have one knife-edge for one bag or three knife-edges for three bags. The cutting quality and the mentioned advantages are the same as for the rotatable cutting member.

Figure 12:
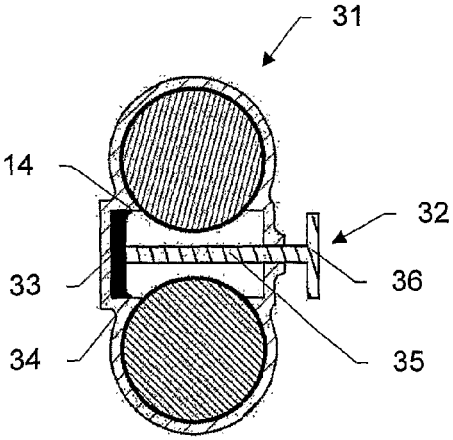
FIGS. 12 and 13 show another embodiment variant of the cutting member.
Figure 13:
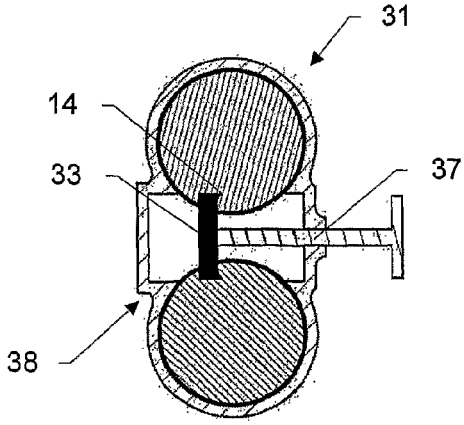

In another embodiment, the cutting member is displaceable transversally to the displacement direction depicted in FIGS. 12 and 13. In FIGS. 12 and 13 an embodiment variant is illustrated in which the cutting member is actuated by a linear displacement rather than a rotation. In dispensing assembly 31, opening means 32 comprise a cutting member 33 having two knife-edges 34 and an actuating rod 35 having a handle 36, the rod being guided in an opening 37 in the correspondingly adapted cartridge housing 38. When comparing FIGS. 12 and 13 it is apparent that in the opening operation, instead of being rotated, the cutting member is pulled from the possibly secured end position toward the center axis while knife-edges 34, possibly provided with edges 14, act essentially perpendicularly to the longitudinal axis of the cartridge as in the previous example.

Instead of a mixer, the accessory connected to the cartridge may consist of a spray device with a spray head, an adapter, or a dispensing tube, the rotatable cutting member being arranged in the coupling section thereof. Alternatively, the rotatable cutting member with the twisting device may be designed as an additional functional unit.

What is claimed is:

1. A dispensing assembly comprising:

a cartridge that includes a cartridge housing and at least one bag placed therein, the bag being elongated along a longitudinal direction, the bag having a sidewall portion and an end portion, the sidewall portion extending essentially parallel to the longitudinal direction; and an opening device acting upon the bag, the opening device comprising a cutting member that is rotatable with respect to the cartridge about a rotation axis, the rotation axis being essentially parallel to the longitudinal direction, the cutting member extending radially outward from the rotation axis and including at least one knife-edge that is arranged and orientated thus as to effectuate a cutting movement that is essentially perpendicular to the rotation axis, the cutting member being arranged adjacent to the sidewall portion of the bag, the cutting member being configured to cut only a limited section of the sidewall portion, the limited section facing the rotation axis.

2. A dispensing assembly according to claim 1, further comprising an accessory having an accessory housing that is rotatable with respect to the cartridge, wherein the cutting member is connected to the accessory housing and actuatable by a rotation of the accessory housing.

3. A dispensing assembly according to claim 1, further comprising an accessory in a form of a mixer comprising a mixer housing and mixing elements that are connected to the mixer housing, wherein the cutting member is connected to the mixing elements.

4. A dispensing assembly according to claim 3, wherein the mixer housing includes actuating wings.

5. A dispensing assembly according to claim 1, wherein the cutting member is actuatable by a rotatably arranged ring.

6. A dispensing assembly according to claim 5, wherein the rotatably arranged ring includes actuating wings.

7. A dispensing assembly according to claim 1, wherein the cartridge is a double cartridge, the cutting member having one or two knife-edges.

8. A dispensing assembly according to claim 7, wherein the cartridge has an outlet flange including a circumferential groove, wherein the mixer has an inlet end including a bead, and wherein the bead is snapped in place in the circumferential groove.

9. A dispensing assembly according to claim 1, wherein the cartridge is a triple cartridge, the cutting member having one or a plurality of knife-edges.

10. A dispensing assembly according to claim 1, further comprising an accessory that is rotatable relative to the cartridge and is arranged on the cartridge in an axially secured manner.

11. A dispensing assembly according to claim 1, wherein the cartridge has at least one stop element configured to limit rotation of the cutting member.

12. A dispensing assembly according to claim 1, wherein the knife-edge extends essentially perpendicular to the rotation axis.

13. A dispensing assembly according to claim 1, wherein the cutting member is rotatable in a direction of rotation, and wherein the knife-edge essentially points in said direction of rotation.

14. A dispensing assembly according to claim 1, wherein the cartridge has at least one retaining element configured to retain the cutting member at a predetermined angle of rotation.

15. A dispensing assembly comprising:

a cartridge that includes a cartridge housing and at least one bag placed therein, the bag defining a longitudinal axis; and an opening device acting upon the bag, the opening device comprising an actuating rod that is guided in the cartridge housing for linear displacement with respect to the cartridge housing, the actuating rod extending through an opening of the cartridge housing and having a handle outside of the cartridge housing, the opening device further comprising a cutting member arranged on the actuating rod, the cutting member including at least one knife-edge that is arranged and orientated thus as to effectuate a cutting movement to open the bag when the handle of the actuating rod is pulled away from the cartridge housing, the cutting movement being essentially perpendicular to the longitudinal axis of the bag.

16. A dispensing assembly according to claim 15, wherein the cutting member is arranged laterally with respect to the bag.

17. A dispensing assembly according to claim 16, wherein the bag has a sidewall portion and an end portion, the sidewall portion extending essentially parallel to the longitudinal axis, and wherein the cutting member is configured to cut the sidewall portion of the bag.

18. A dispensing assembly according to claim 15, wherein the knife-edge extends essentially perpendicular to the longitudinal axis of the bag within the cartridge.

19. A dispensing assembly according to claim 15, wherein the actuating rod is linearly displaced in a displacement direction when the actuating rod is pulled away from the cartridge housing, and wherein the knife-edge essentially points in said displacement direction.

20. A dispensing assembly according to claim 15, further comprising an accessory that is connectable to the cartridge.

21. A dispensing assembly according to claim 15, wherein the knife-edge extends essentially perpendicular to the actuating rod.

* * * * *